US005673917A

United States Patent [19]

Vancura

[11] Patent Number: 5,673,917

[45] Date of Patent: Oct. 7, 1997

[54] METHOD OF PLAYING A CASINO BLACKJACK SIDE WAGER

[76] Inventor: Olaf Vancura, 11 Linden Pl., Somerville, Mass. 02143

[21] Appl. No.: 646,869

[22] Filed: May 8, 1996

[51] Int. Cl.[6] ..... A63F 1/00

[52] U.S. Cl. ..... 273/292; 273/274

[58] Field of Search ..... 273/292, 274, 273/309; 463/12, 13

[56] References Cited

U.S. PATENT DOCUMENTS

| | | | |
|---|---|---|---|
| 4,836,553 | 6/1989 | Suttle et al. | 273/292 |
| 4,861,041 | 8/1989 | Jones et al. | 273/292 |
| 5,098,107 | 3/1992 | Boylan et al. | 273/292 |
| 5,154,429 | 10/1992 | Le Vasseur | 273/292 |
| 5,174,579 | 12/1992 | Griffiths | 273/292 |
| 5,288,077 | 2/1994 | Jones | 273/292 |
| 5,322,295 | 6/1994 | Cabot et al. | 273/292 |
| 5,364,105 | 11/1994 | Jones | 273/292 |
| 5,368,305 | 11/1994 | Rodda et al. | 273/292 |
| 5,377,993 | 1/1995 | Josephs | 273/292 |
| 5,390,934 | 2/1995 | Grassa | 273/292 |
| 5,407,209 | 4/1995 | Prerost | 273/292 |
| 5,411,268 | 5/1995 | Nelson et al. | 273/292 |
| 5,413,353 | 5/1995 | Demarest et al. | 273/292 |
| 5,454,570 | 10/1995 | Karal | 273/292 |
| 5,494,296 | 2/1996 | Grassa | 273/292 |

OTHER PUBLICATIONS

Vancura, Olaf, "Smart Casino Gambling," 1996, pp. 175–215, 232–233, 313–317.

Thorp, Edward O., "Beat The Dealer", 1962, pp. 16–17.

Scarne, John, Sarne's New Complete Guide to Gambling 1974, pp. 350–355.

*Primary Examiner*—Benjamin H. Layno

[57] ABSTRACT

The invention comprises a side wager to the game of blackjack or Twenty-One. This side wager allows players to wager on the number of hits that they and/or the dealer will ultimately take. The resolution of the main wager can proceed in the usual fashion, and the game is robust in that it can accommodate common rules variations among casinos. Unlike existing blackjack side wagers, players are actively in control of their fortunes and can play hands as they wish. This added feature affords players considerable excitement and interest, and mathematically, makes the main and side wagers dependent on each other. The game can be played on a standard blackjack playing surface with additional delineated areas for making the side bet.

24 Claims, 5 Drawing Sheets

Preferred Rewards

| Number of Hits: | Payoff: |
|---|---|
| 0 | Loses |
| 1 | 1 to 1 |
| 2 | 2 to 1 |
| 3 | 4 to 1 |
| 4 | 5 to 1 |
| 5 | 15 to 1 |
| 6 | 50 to 1 |
| 7 | 500 to 1 |
| 8+ | 1000 to 1 |

Alternate Rewards

| Number of Hits: | Payoff: |
|---|---|
| 0 | Loses |
| 1 | Push |
| 2 | 4 to 1 |
| 3 | 6 to 1 |
| 4 | 10 to 1 |
| 5 | 20 to 1 |
| 6 | 100 to 1 |
| 7 | 500 to 1 |
| 8+ | 2500 to 1 |

FIGURE 3:

Preferred Rewards

| Number of Hits: | Payoff: |
|---|---|
| 0 | Loses |
| 1 | 1 to 1 |
| 2 | 2 to 1 |
| 3 | 4 to 1 |
| 4 | 5 to 1 |
| 5 | 15 to 1 |
| 6 | 50 to 1 |
| 7 | 500 to 1 |
| 8+ | 1000 to 1 |

Alternate Rewards

| Number of Hits: | Payoff: |
|---|---|
| 0 | Loses |
| 1 | Push |
| 2 | 4 to 1 |
| 3 | 6 to 1 |
| 4 | 10 to 1 |
| 5 | 20 to 1 |
| 6 | 100 to 1 |
| 7 | 500 to 1 |
| 8+ | 2500 to 1 |

FIGURE 5:

Rewards for (D 0 hits)

| Dealer Hits: | Payoff: |
|---|---|
| 0 | 1 to 1 |
| 1+ | Loses |

Rewards for (D 1 hit)

| Dealer Hits: | Payoff: |
|---|---|
| 0 | Loses |
| 1 | 1 to 1 |
| 2+ | Loses |

Rewards for (D 2+ hits)

| Dealer Hits: | Payoff: |
|---|---|
| 0 or 1 | Loses |
| 2+ | 10 to 1 |

Rewards for (P 1 hit)

| Player Hits: | Payoff: |
|---|---|
| 0 | Loses |
| 1 | 1 to 1 |
| 2+ | Loses |

Rewards for (P 2 hits)

| Player Hits: | Payoff: |
|---|---|
| 0 or 1 | Loses |
| 2 | 5 to 1 |
| 3+ | Loses |

Rewards for (P 3+ hits)

| Player Hits: | Payoff: |
|---|---|
| 0, 1, or 2 | Loses |
| 3+ | 20 to 1 |

METHOD OF PLAYING A CASINO BLACKJACK SIDE WAGER

FIELD OF THE INVENTION

This invention relates to betting games suitable for casino play.

BACKGROUND OF THE INVENTION

All casino games by their nature should have a positive expectation for the house and be easy to understand, easy to deal, and fun to play. These attributes are found in all table games.

Casino games generally fall into two classes: those consisting of independent events and those consisting of dependent events. Examples of independent event games are craps and roulette, where, in principle, every new game is totally unrelated to past and future games.

Blackjack or Twenty-One, on the other hand, is the most famous casino game comprised of dependent events. This is because past hands influence the outcome of future hands. This arises specifically because, in between shuffles, subsequent hands in a blackjack game are dealt from the same pack. Thus, players who track the cards already played, commonly referred to as card-counters, obtain information about the cards remaining. In casino blackjack, the player and dealer each have unique cards associated with their respective hands, and players are allowed to play their hands in whatever fashion they desire. Thus there is a spirit of competition between the player and the house.

Blackjack variations such as Multiple-Action Blackjack (LeVasseur, U.S. Pat. No. 5,154,429, 1992), Face-Up 21, Spanish 21, and California 22 have become popular. Rainbow Blackjack, (Grassa, U.S. Pat. No. 5,390,934 and U.S. Pat. No. 5,494,296) where the rules of play are the same but each player is assigned a color and players are allowed to wager on each other's colors, is another try that is reminiscent of back-lining, where bystanders can wager with a particular player. In a further effort to enhance casino handle (total money wagered) as well as provide players additional excitement, blackjack side wagers have also become widely accepted.

A desired quality of any blackjack side bet is that it be optional. In this way, players who don't want to make the side bet are not required to do so. Players not making the side wager instead play a normal blackjack game. From a casino point of view, making the side bet optional is also desirable, for there is then very little risk in introducing it. If the side bet is unsuccessful (no one wants to wager on it), the blackjack table by default will revert back to its classic denotation.

Several optional blackjack side wagers have appeared in recent years. These include the Over/Under 13, Super 7s, Top of the Deck, Royal Match (Boylan et al., U.S. Pat. No. 5,098,107, 1992), and Bust-Out wagers. Too, a separate jackpot wager achieved through a predetermined arrangement of cards has been proposed (Jones et al., U.S. Pat. No. 4,861,041, 1989).

Unfortunately for players, none of these side bets gives them much to do. In this sense they are not very thematic, as in blackjack (unlike for example, baccarat) players are used to being in control of their hand.

The Top of the Deck wager is a side bet on whether or not the player and/or dealer will receive a natural (a two-card total of 21). It has no "play" value, per se, in that the outcome of the wager is decided merely on the basis of the first two cards dealt to the player and/or dealer. Players cannot adopt a strategy nor do they have any decisions to make in an effort to try to win. In this sense, it is a passive bet. Too, Top of the Deck suffers with restrictive rules as to when players can make the bet (only immediately after a shuffle). Thus, players can make the wager typically only once every few hands.

The Over/Under 13 wager is a side bet on whether the player's first two cards will total over or under 13. It is made at the start of a new hand. Again, there is nothing for the player to do once the bet has been made.

The Royal Match wager is a side bet on whether the player's first two cards will be of the same suit. It is made at the start of a new hand, but is also a completely passive bet.

The Super 7s wager is a bet on whether or not the player will receive one or more Sevens in his/her hand. It too is made at the start of a new hand. It is not completely passive; the player has a decision to make roughly once in every 170 hands. But in all other cases (the vast majority), there is nothing to do. Indeed, any jackpots which are paid on a predetermined arrangement of rare cards (cf. U.S. Pat. No. 4,861,041 mentioned above) succumb to this problem.

On the other hand, Super 7s has the desirable feature of offering a high jackpot payoff (if a player receives a hand of three suited Sevens). A similar large jackpot can be found in the Caribbean Stud casino table game (Suttle et al., U.S. Pat. No. 4,836,553, 1989). However, Super 7s has the undesirable trait of paying off about once in every 13 hands. Over 92% of the time players simply lose the wager without having any say in the matter.

The Bust-Out side wager is different in that it is made while the hand is in progress. If the dealer has a "stiff" hand (a hard 12 through 16), then players are allowed to wager on whether the next card will have a value of Ten (10, Jack, Queen, or King). In the mathematical sense, it is equivalent to the insurance bet. However, again, players have nothing to do once the bet is made, for they will either win or lose on the turn of the next card.

Some blackjack video machines decree that "Six-card Charlies", which are unbusted hands consisting of six cards, are automatic winners of the main wager. Spanish 21 also presently has a small bonus for five, six, or seven card totals of 21, also counting these hands as automatic winners.

However, in each of these cases, the bonus is included at the expense of other major rules variations which are unfavorable to the player. For example, the blackjack video machines typically pay naturals at a 1 to 1 rate, less than the standard 3 to 2 customary on table games. Spanish 21 has no 10-valued cards in the pack, also a severe disadvantage to the player. Too, some casinos in the past have paid bonuses for seven-card totals of exactly 21.

In each of the above bonus scenarios, the potential bonuses are included as a part of the main wager; the player need not make an extra wager to be eligible. Because these bonuses are included in the main wager and pay only a small amount relative to their very rare frequency, they in and of themselves do not appreciably change the character (or optimal strategy) of the game.

Finally, because some players are wary of their own chances, knowing "the odds are stacked for the dealer", any side bet utilizing perhaps not only the player's hand but also the dealer's hand is especially interesting. Only the Top of the Deck blackjack side bet presently offers an added reward if both player and dealer achieve a special hand.

There is therefore the need for a blackjack side wager that is exciting, easy-to-play, difficult to beat by card-counting, and allows players to formulate their own strategy in play. By letting players actively participate in the outcome of the side bet, the outcome of the main and side wagers become dependent on each other. Ideally, the side wager can be constructed so that with optimal play it will have a positive expectation for the player, which comes at the expense of the main wager becoming more negative for the player. Of course, when the two wagers (main and side) are considered together, the overall expectation is still negative for the player, as required.

The wager also needs to be available and have a good chance of winning on every hand, and needs to make little or no changes to the regular rules of play for blackjack. Ideally, such a game also includes a large "jackpot" payoff for achieving an unlikely hand.

BRIEF SUMMARY OF THE INVENTION

The present invention is a method for playing a side wager associated with the conventional game of casino blackjack or a variation thereof. The game is played on the standard blackjack playing surface with an extra area for making the side wager, adjacent to the area delineated for making the main wager. In principle, wagers may be made with money, gaming chips, credits, or their video or mechanical equivalent.

The game employs a method of paying off according to how many hits, or draws, that a player takes during the course of his/her hand. The rest of the rules of blackjack can remain exactly as before. Indeed, the resolution of the main wager may proceed in exactly the same fashion. In this way, the invention conforms to the subtle yet common variations in rules and/or conditions that exist between casinos. The invention can also accommodate different versions of blackjack, including Multiple-Action Blackjack, Spanish 21, and Face-Up 21, or other variations where the rules, deck constituencies, and/or conditions have been significantly altered. For example, it can conform to the popular California blackjack variation known as California 22, where the best hand is one with a total of 22. Too, this additional wager is robust in the sense that many different variations of rules and/or payouts for the side bet are possible.

The introduction of this invention causes the overall "optimal" strategy to change considerably. Unlike the existing blackjack side bets where the player has little, if anything, to do, this invention affords the player considerable control over the outcome. Playing with the classical "basic strategy" (a set of rules meant to optimize the player's expectation taking into account only information from the present player and dealer hands) does not fare well for the side bet. Alternatively, developing a strategy to optimize the player's expectation on the side wager, with no regard for the main wager, is also a hopeless effort.

Rather, because the side wager is tied to the number of hits taken, its outcome is clearly linked to the outcome of the main wager which also depends on a player's hitting and standing strategy. In the mathematical sense, the side bet is dependent on the main wager (and vice-versa), so the "optimal" strategy is to maximize the total return of the player considering the consequences of the main and side wagers together. Indeed, it is correct to depart from the classical "basic strategy" when the gain in doing so (for the side bet) outweighs the loss in doing so (for the main bet).

That the best method of play tan be substantially different from the classical "basic strategy" is an added feature that is unlike any of the aforementioned blackjack side bets. Until now, the basic strategy has been applicable (except under very rare circumstances in Super 7s) whether or not any blackjack side bet was made, since so little play has been involved in making the side wager. Here clearly this is no longer true. Indeed, the invention can be constructed so that with best play, players will have a positive expectation on the side wager, at the expense of further losses on the main portion of the bet, leading to an overall negative expectation when considering the totality of bets. Card-counting is difficult because an abundance of low cards, though clearly desirable for the side wager, is at the same time detrimental to the main wager.

This side wager can be offered in conjunction with another wager that pays off according to how many hits the dealer takes. Since the house always plays by a fixed set of rules, no playing strategy is involved in the case of a side wager on the dealer's hand. In another embodiment, players may make the side wager on each other's hands, in addition to their own. Similarly, bystanders may be allowed to make or back-line the side wager on a player's hand.

One of the embodiments has the player lose the side wager if he should bust (hit to a total exceeding 21). This is in keeping with the theme of blackjack where a player automatically loses in this case. In another embodiment, the player's total number of hits (regardless of whether the last hit was successful or a bust) determines the payoff.

In another embodiment, if a player busts, he keeps any amount won on the side wager prior to that point. That is, if the player makes a series of successful hits (a successful hit consists of drawing a card without busting) only to bust on the final hit, he will still retain the amount won based on the last successful hit. In this way, the player can try for more hits (and bigger jackpot-type rewards) for "free" in the sense that he won't lose any rewards already gained on the side wager. This feature is unique to casino games, and allows players to try for large jackpot hands (through continued hitting) knowing they cannot lose what they have already won. By ultimately busting, the player does lose the main wager however.

In one embodiment, the player loses if receiving a natural whereas another has the player push (tie). Too, in one embodiment the player loses if the dealer receives a natural, whereas another embodiment has the player push in this case. Too, one embodiment has the player push if he elects to double down, split, or surrender while playing the hand; other embodiments have the side wager proceed in the usual fashion.

Clearly, too, different payouts based on different numbers of successful hits constitute a range of possible embodiments. For example, in one embodiment the player is rewarded for successfully taking any of an integer range of hits, for example one or more. In another embodiment, the player is rewarded for taking an exact prescribed integer number of hits, for example two.

In additional embodiments, payoffs for the side wager are enhanced if the dealer busts, or if both player and dealer take a prescribed number of hits, or if either reaches a desired hand total.

Additional embodiments arise in regard to the amount of the side wager. This is an important facet of the game particularly with regard to card-counting, or the tracking of cards by players in an effort to try to gain an advantage in the game. In one embodiment, the player is allowed to wager only a fixed amount on the side bet. In another, the side wager can vary subject to a maximum percentage of the main wager. In still another, the side wager can vary subject to some fixed ceiling.

In a preferred method of play, designed to largely negate the effects of card-counting, players are allowed to wager up to ⅕ the amount of the main wager. The player is rewarded for taking one or more hits. Should the player bust, he is paid based on the number of successful (non-busting) hits prior to that point. In this way, all players who take even just one successful hit are automatic winners of the side bet. Players who take more successful hits are rewarded more. A player or dealer natural is a loss for the side bet, but if the player doubles down or splits the hand, then the side wager is a push.

BRIEF DESCRIPTION OF THE DRAWINGS

The accompanying drawings illustrate the invention. In such drawings:

FIG. 3 is a table showing the preferred and an alternate set of rewards in the preferred embodiment of the invention, other sets of rewards are also possible;

FIG. 5 is a table showing the preferred rewards for an alternate embodiment of the invention.

DETAILED DESCRIPTION OF THE PREFERRED EMBODIMENTS

Figure 1:
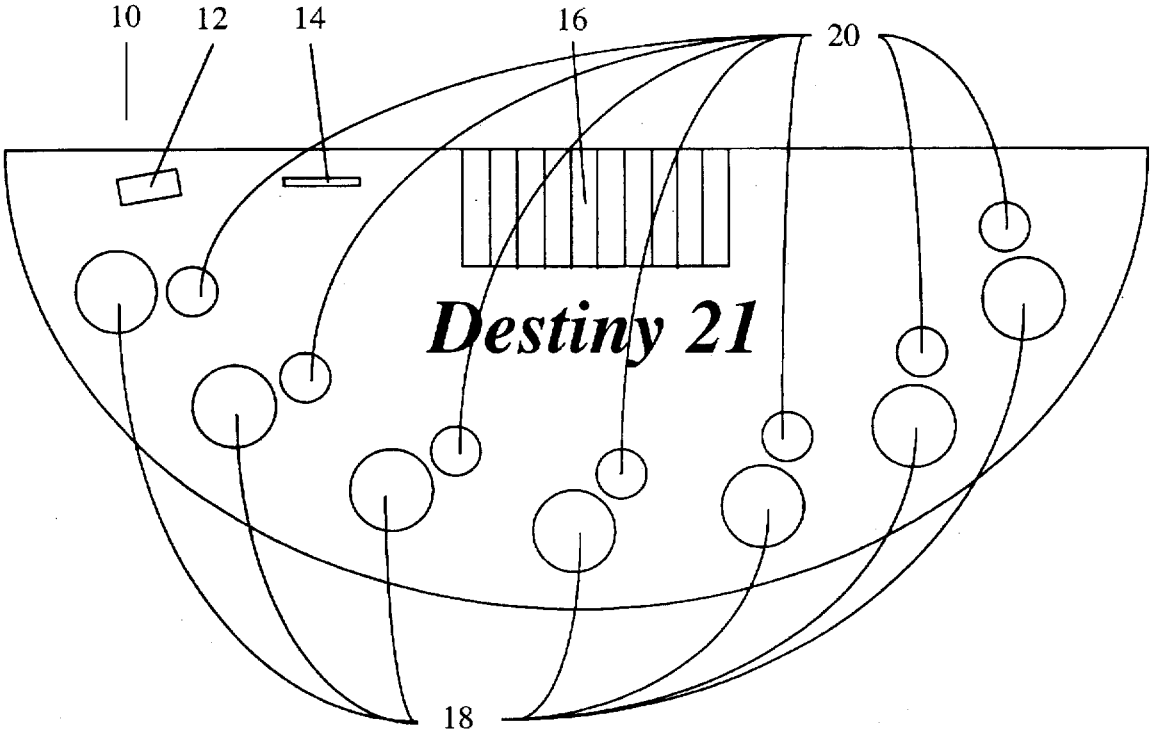
FIG. 1 is a top view illustration of a preferred layout for the preferred embodiment of the invention.
Figure 2:
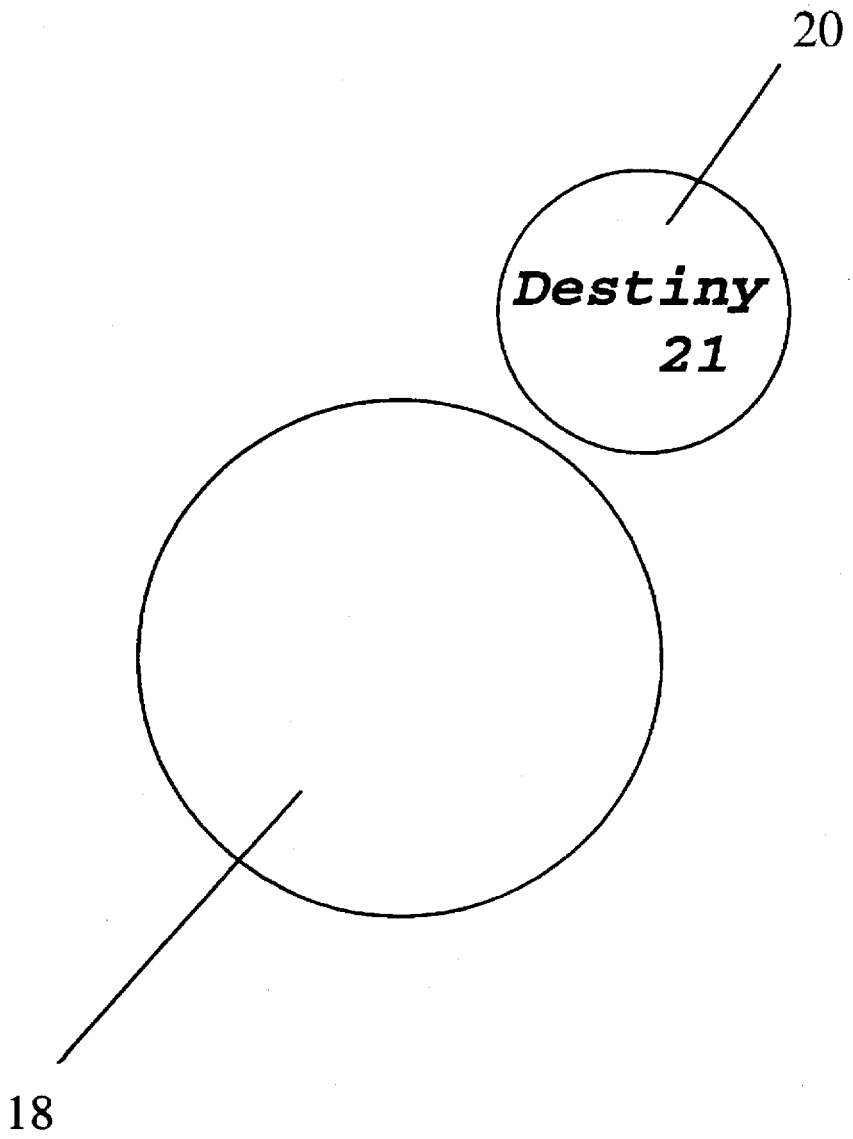
FIG. 2 is a close-up top view illustration of a preferred wagering area for the preferred embodiment of the invention.

FIG. 1 shows a playing surface 10 for a betting game that employs the conventional game of blackjack and adds the novel side wager. As in the conventional game, a designated dealer, representing the casino, brokers the game and deals the pack of cards. Typical tables are equipped with a card discard holder 12, a money drop slot 14, and a dealer's chip tray 16. The main wagering areas 18 and side wagering areas 20 are each depicted. FIG. 2 shows a close-up of the player's wagering area. Payoffs are set for the player taking any number of a range of hits, as designated in the rewards of FIG. 3.

Before a hand begins, players, by placing bets of money, gaming chips, credits, or their video or mechanical equivalent in the appropriate areas, may wager on the main and side bets.

The dealer deals two cards to every player and himself. One of the dealer's cards is dealt face-up. If the dealer has a natural, then all the players lose both the main and side wager (unless a player, too, has a natural, in which case he pushes the main wager and loses the side wager). If the dealer does not have a natural, the players in turn then play out their hands abiding by the normal rules of blackjack.

The player, upon successfully taking one or more hits, will be paid on the side wager. That is, if a player takes three hits without busting and then stands, he will be paid according to the payoff table for three successful hits. Similarly, if he takes three hits successfully and then busts on the fourth hit, the player will still be paid according to the payoff table for three successful hits. If the player takes no hits, then the side wager is lost.

If the player decides to surrender the hand, then the side wager is a push. Similarly, if the player's first two cards are of the same value (for example, Ace-Ace or Jack-Queen), then he may elect to split the hand. This entails putting out another wager equal to the original. Each original card then becomes the first card of a new hand. In splitting, the side wager is also a push. Alternatively, the player may decide to double down. This entails putting out another wager up to the original amount. The player then receives one and only one more card. The side wager is a push in this case also. The main hand is then resolved in the usual manner.

Figure 4:
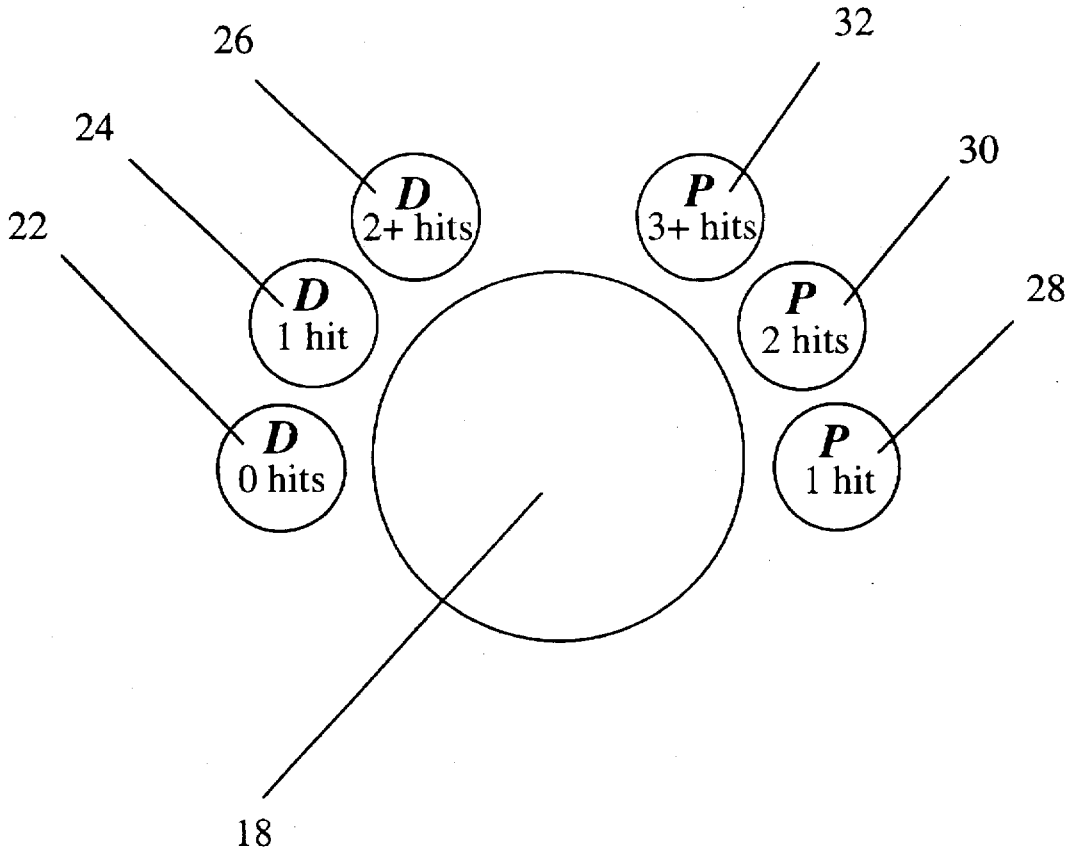
FIG. 4 is a close-up top view illustration of a preferred wagering area for an alternate embodiment of the invention.

FIG. 4 shows a close-up of a player's wagering area in an alternate embodiment where more side wagers are possible. In this case, the player may again wager on the main wager 18. In this embodiment, however, the player has the option of making any of three side wagers based on the dealer's hand and three side wagers based on the player's own hand. The player may wager 22 that the dealer will take no hits, 24 that the dealer will take exactly one hit, or 26 that the dealer will take two or more hits. Or, the player may wager on himself, either 28 for exactly one hit, 30 for exactly two hits, or 32 for three or more hits. In this embodiment all busts lose for their respective bets. That is, all side bets based on the player's hand lose if the player busts; all side bets based on the dealer's hand lose if the dealer busts. The preferred payoffs are displayed in FIG. 5.

While the invention has been described with reference to specific embodiments, other variations or modifications will be apparent to those skilled in the art. Therefore, the invention should not be limited by the foregoing description. Rather, the scope is to be interpreted only in conjunction with the appended claims.

What is claimed:

1. A method of playing a blackjack casino game with money, gaming chips, and/or credits by one or more players playing against a dealer comprising the steps of:

providing each player with a main wagering area and at least one side wagering area, each said side wagering area representing a wager on the number of hits taken while playing blackjack;

each player placing a main wager on their main wagering area to participate in the blackjack game;

each player placing a side wager on at least one of said side wagering areas to participate in the side wager;

the dealer dealing each player a player hand of two cards, and the dealer dealing a dealer hand of two cards, and the player and dealer taking hits according to the rides of blackjack;

paying the player on the side wager according to the number of hits taken and according to a payoff table, and comparing each of the players' hands with the dealer's hand and the dealer resolving the main wagers by paying off winning players and taking the main wagers of losing players according to the rules of blackjack.

2. The method of playing blackjack according to claim 1 further comprising the step of:

wherein at least one side wagering area representing the number of hits taken by the player.

3. The method of playing blackjack according to claim 2 further comprising the step of:

if the player busts the player loses the side wager.

4. The method of playing blackjack according to claim 2 further comprising the step of:

if the player busts the player is paid according to the total number of prior successful hits before busting.

5. The method of playing blackjack according to claim 2 further comprising the step of:

if the player busts the player is paid according to the total number of hits including the last hit causing the bust.

6. The method of playing blackjack according to claim 1 further comprising the step of:

wherein at least one side wagering area representing the number of hits taken by the dealer.

7. The method of playing blackjack according to claim 6 further comprising the step of:

if the dealer busts the player loses the side wager.

8. The method of playing blackjack according to claim 6 further comprising the step of:

if the dealer busts the player is paid according to the total number of prior successful hits before busting.

9. The method of playing blackjack according to claim 6 further comprising the step of:

if the dealer busts the player is paid according to the total number of hits including the last hit causing the bust.

10. The method of playing blackjack according to claim 1 further comprising the step of:

at least one of said side wagering areas comprising an integer range of hits.

11. The method of playing blackjack according to claim 1 further comprising the step of:

at least one of said side wagering areas comprising a single integer number of hits.

12. The method of playing blackjack according to claim 1 further comprising the step of:

either requiring or not requiring each player to place a side wager.

13. The method of playing blackjack according to claim 1, further comprising the step of:

if a player receives a natural the side wager is a push.

14. The method of playing blackjack according to claim 1 further comprising the step of:

if the dealer receives a natural the side wager is a push.

15. The method of playing blackjack according to claim 1 further comprising the step of:

if the player decides to either double down, split, or surrender, then the side wager is a push.

16. The method of playing blackjack according to claim 1 further comprising the step of:

if the player decides to surrender, then the side wager loses.

17. The method of playing blackjack according to claim 1 further comprising the step of:

if the player decides to split, then the side wagers continue on the first split hand.

18. The method of playing blackjack according to claim 1 further comprising the step of:

if the player decides to split, forming a second split hand, said player is required to make an equivalent additional side wager on the second split hand.

19. The method of playing blackjack according to claim 1 further comprising the step of:

paying the player according to the number of hits taken and according to a payoff table dependent in part on either the number of hits the dealer takes, the total value of said player and/or dealer hand, or whether on not the dealer busts.

20. The method of playing blackjack according to claim 1 further comprising the step of:

wherein the amount of the side wagers is a fixed fraction of the amount of the main wager.

21. The method of playing blackjack according to claim 1 further comprising the step of:

wherein the amount of the side wagers is a fixed regardless of the amount of the main wager.

22. The method of playing blackjack according to claim 1 further comprising the step of:

wherein the amount of the side wagers is subject to a maximum, said maximum being a fixed fraction of the amount of said main wager.

23. The method of playing blackjack according to claim 1 further comprising the step of:

wherein the amount of the side wagers is subject to a maximum, said maximum being a fixed regardless of the amount of said main wager.

24. The method of playing a blackjack casino game to be played with money, gaming chips, and/or credits, one or more players and a dealer, comprising the steps of:

establishing a collection of side wagers based on the number of hits a player will take;

establishing a collection of side wagers based on the number of hits a dealer will take;

providing each player with areas for wagering on said side wagers and a main wager to participate in a blackjack game;

accepting bets for said main wager, and at a player's discretion, a subset of said side wagers;

while playing according to the rules of blackjack, rewarding successful main bets and collecting unsuccessful main bets, and rewarding successful side bets according to the number of hits taken and according to a payoff table, and collecting unsuccessful side bets.

* * * * *